US009562674B2

(12) United States Patent
Kim et al.

(10) Patent No.: US 9,562,674 B2
(45) Date of Patent: Feb. 7, 2017

(54) LIGHTING DEVICE

(71) Applicant: LG INNOTEK CO., LTD., Seoul (KR)

(72) Inventors: Ji Hoo Kim, Seoul (KR); Tae Young Choi, Seoul (KR); Do Hwan Kim, Seoul (KR); Sung Ku Kang, Seoul (KR); Chan Hyung Jung, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 15/143,005

(22) Filed: Apr. 29, 2016

(65) Prior Publication Data

US 2016/0245464 A1 Aug. 25, 2016

Related U.S. Application Data

(63) Continuation of application No. 14/561,835, filed on Dec. 5, 2014, now Pat. No. 9,353,915, which is a (Continued)

(30) Foreign Application Priority Data

Jul. 8, 2011 (KR) ..... 10-2011-0067673

(51) Int. Cl.
*F21V 29/77* (2015.01)
*F21V 19/00* (2006.01)
(Continued)

(52) U.S. Cl.
CPC ..... *F21V 19/001* (2013.01); *F21K 9/23* (2016.08); *F21V 3/00* (2013.01); *F21V 21/00* (2013.01);
(Continued)

(58) Field of Classification Search
CPC ..... F21K 9/1355; F21V 29/773; F21V 29/75; F21V 23/06
See application file for complete search history.

(56) References Cited

U.S. PATENT DOCUMENTS

2001/0024368 A1 9/2001 Henrici et al.
2002/0176253 A1 11/2002 Lee
(Continued)

FOREIGN PATENT DOCUMENTS

FR 2 894 324 6/2007
JP 2009-093926 A 4/2009
(Continued)

OTHER PUBLICATIONS

Japanese Office Action issued in Application No. 2014-518830 dated May 10, 2016.
(Continued)

*Primary Examiner* — David V Bruce
(74) *Attorney, Agent, or Firm* — KED & Associates LLP

(57) ABSTRACT

A lighting device may be provided to include a heat sink which includes a receiving recess and a top surface including a hole; a light source module which includes a substrate disposed on the heat sink, a light emitting device disposed on the substrate and a pad disposed on the substrate; a power supplier which is disposed in the receiving recess of the heat sink and includes a projection outputting a power signal for driving the light source module; and a connector which is coupled to the hole of the heat sink, includes a contacting part electrically connected to the pad of the light source module, and is electrically connected to the projection of the power supplier.

20 Claims, 15 Drawing Sheets

Related U.S. Application Data continuation of application No. 13/574,164, filed as application No. PCT/KR2012/005387 on Jul. 6, 2012, now Pat. No. 8,931,921.

(51) Int. Cl.

| | |
|---|---|
| ***F21V 21/00*** | (2006.01) |
| ***F21V 29/00*** | (2015.01) |
| ***F21V 23/00*** | (2015.01) |
| ***F21V 23/06*** | (2006.01) |
| ***F21V 29/75*** | (2015.01) |
| ***F21V 29/73*** | (2015.01) |
| ***F21V 3/00*** | (2015.01) |
| ***F21V 23/02*** | (2006.01) |
| *F21V 3/04* | (2006.01) |
| *F21V 31/04* | (2006.01) |
| *F21K 99/00* | (2016.01) |
| *F21V 17/16* | (2006.01) |
| *F21Y 101/00* | (2016.01) |

(52) U.S. Cl.

CPC ..... *F21V 23/001* (2013.01); *F21V 23/006* (2013.01); *F21V 23/02* (2013.01); *F21V 23/06* (2013.01); *F21V 29/22* (2013.01); *F21V 29/73* (2015.01); *F21V 29/75* (2015.01); *F21V 29/77* (2015.01); *F21V 29/773* (2015.01); *F21K 9/90* (2013.01); *F21V 3/0418* (2013.01); *F21V 3/0436* (2013.01); *F21V 17/164* (2013.01); *F21V 23/002* (2013.01); *F21V 23/009* (2013.01); *F21V 31/04* (2013.01); *F21Y 2101/00* (2013.01); *F21Y 2105/10* (2016.08); *F21Y 2105/12* (2016.08)

(56) References Cited

U.S. PATENT DOCUMENTS

| | | | |
|---|---|---|---|
| 2008/0285271 | A1 | 11/2008 | Roberge |
| 2010/0096992 | A1 | 4/2010 | Yamamoto |
| 2010/0277067 | A1 | 11/2010 | Maxik et al. |
| 2011/0028015 | A1 | 2/2011 | Mostoller et al. |
| 2011/0140136 | A1 | 6/2011 | Daily et al. |
| 2011/0204393 | A1 | 8/2011 | Masumoto et al. |
| 2012/0025708 | A1 | 2/2012 | Choi et al. |

FOREIGN PATENT DOCUMENTS

| | | | |
|---|---|---|---|
| JP | 2009-206104 | A | 9/2009 |
| JP | 2010-135309 | A | 6/2010 |
| JP | 2010-146952 | A | 7/2010 |
| JP | 2010-218959 | A | 9/2010 |
| JP | 2011-124577 | A | 6/2011 |
| JP | 2011-134665 | A | 7/2011 |
| KR | 10-2010-0052121 | A | 5/2010 |
| KR | 20-0450948 | Y1 | 11/2010 |
| KR | 10-1028339 | B1 | 4/2011 |
| KR | 10-1045457 | B1 | 7/2011 |

OTHER PUBLICATIONS

International Search Report dated Jan. 17, 2013 issued in Application No. PCT/KR2012/0053897.

Office Action dated May 23, 2014, issued in (grand-parent) U.S. Appl. No. 13/574,164.

Notice of Allowance dated Sep. 8, 2014, issued in (grand-parent) U.S. Appl. No. 13/574,164.

Notice of Allowance dated Feb. 2, 2016, issued in (parent) U.S. Appl. No. 14/561,835.

European Search Report dated Jun. 16, 2016 issued in Application No. 16162820.1.

LIGHTING DEVICE

CROSS-REFERENCE TO RELATED APPLICATIONS

This application is a Continuation of U.S. application Ser. No. 14/561,835 filed Dec. 5, 2014 (now U.S. Pat. No. 9,353,915), which is a Continuation Application of U.S. application Ser. No. 13/574,164, filed Jul. 19, 2012 (now U.S. Pat. No. 8,931,921), which is a U.S. National Stage Application under 35 U.S.C. §371 of PCT Application No. PCT/KR2012/005387 filed Jul. 6, 2012, which claims priority to Korean Patent Application No. 10-2011-0067673, filed Jul. 8, 2011, the entireties of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

BRIEF DESCRIPTION OF THE DRAWINGS

The embodiments will be described in detail with reference to the following drawings in which like reference numerals refer to like elements wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being cony or "under" another element, it may be directly on/under the element, and/or one or more intervening elements may also be present. When an element is referred to as being cony or 'under', 'under the element' as well as 'on the element' may be included based on the element.

An embodiment may be described in detail with reference to the accompanying drawings.

Figure 1:
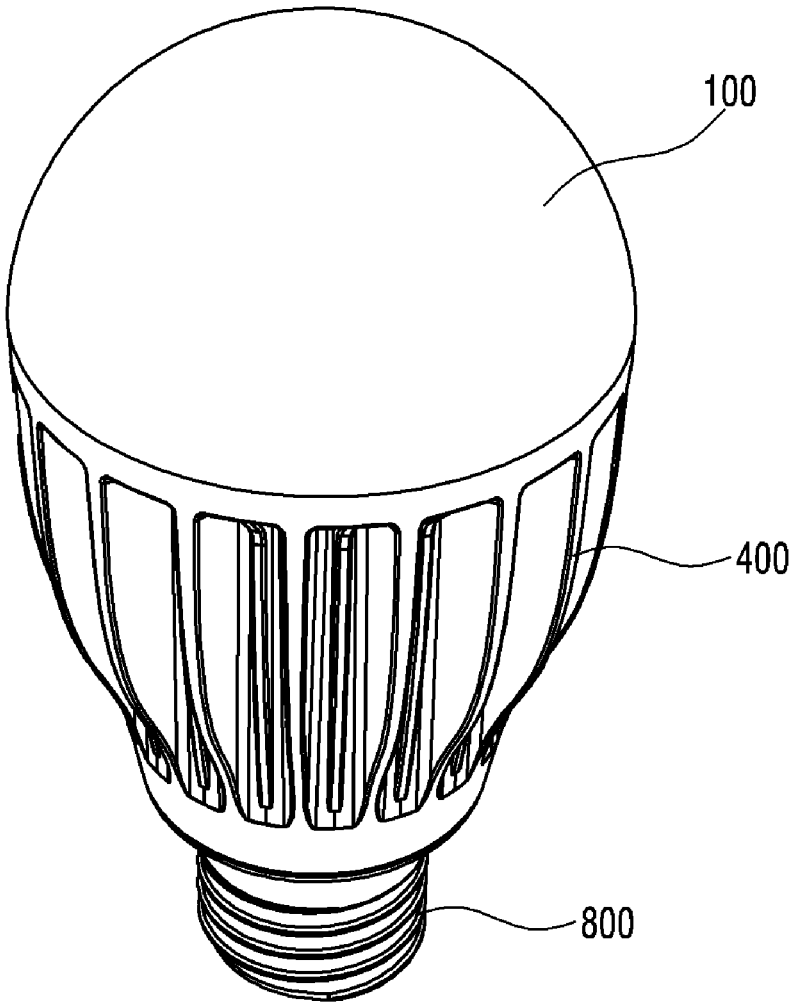
FIG. 1 is a top perspective view of a lighting device according to an embodiment.
Figure 2:
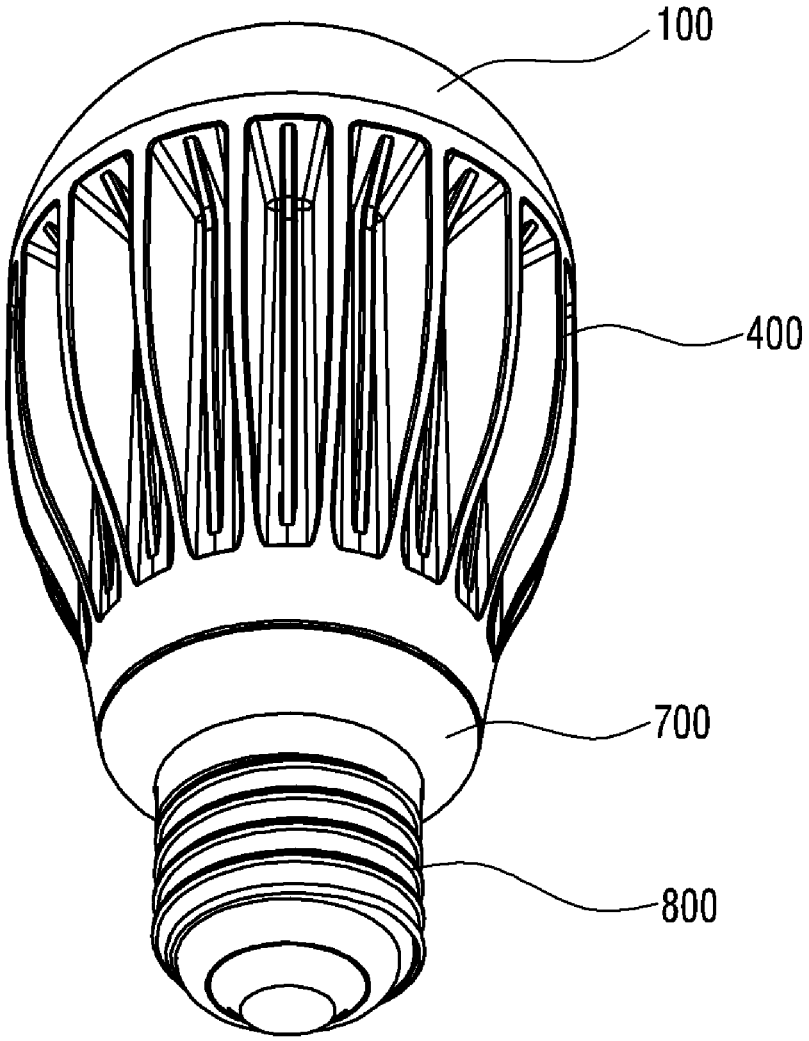
FIG. 2 is a bottom perspective view of the lighting device shown in FIG. 1.
Figure 3:
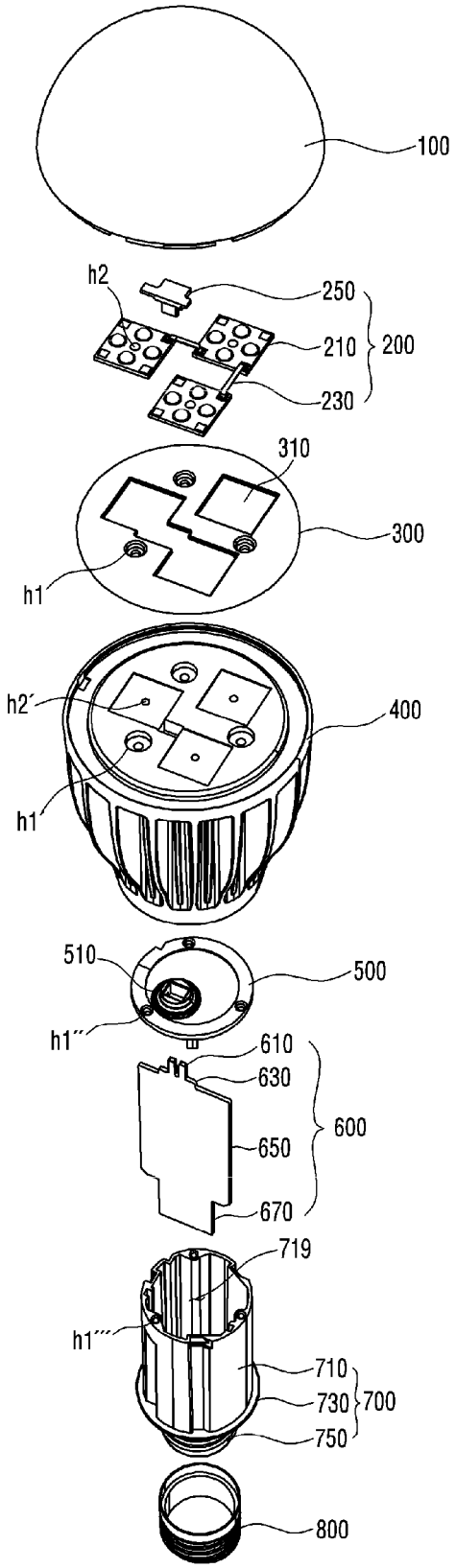
FIG. 3 is an exploded perspective view of the lighting device shown in FIG. 1.

FIG. 1 is a top perspective view of a lighting device according to an embodiment. FIG. 2 is a bottom perspective view of the lighting device shown in FIG. 1. FIG. 3 is an exploded perspective view of the lighting device shown in FIG. 1.

Referring to FIGS. 1 to 3, the lighting device according to the embodiment may include a cover 100, a light source module 200, a heat sink 400, a power supplier 600, an inner case 700 and a socket 800. Also, the lighting device according to the embodiment may further include at least one of a member 300 and a holder 500.

Each of the components will be described in detail with reference to the accompanying drawings.

The cover 100 has a bulb shape or a hemispherical shape. The cover 100 has an empty interior and an open portion.

The cover 100 is optically connected to the light source module 200. Specifically, the cover 100 is able to diffuse and scatter light emitted from the light source module 200. The cover 100 is excited by the light and may emit excited light.

The cover 100 is coupled to the heat sink 400. The cover 100 may include a coupler which is connected to the heat sink 400. Specifically, a coupling structure between the cover 100 and the heat sink 400 will be described with reference to FIGS. 4 and 5.

Figure 4:
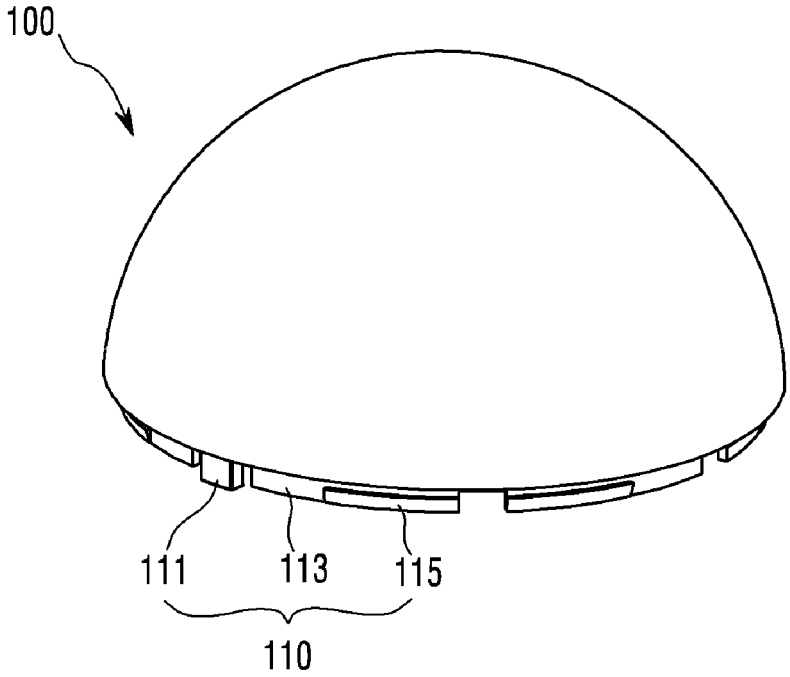
FIG. 4 is a perspective view of a cover shown in FIG. 3.
Figure 5:
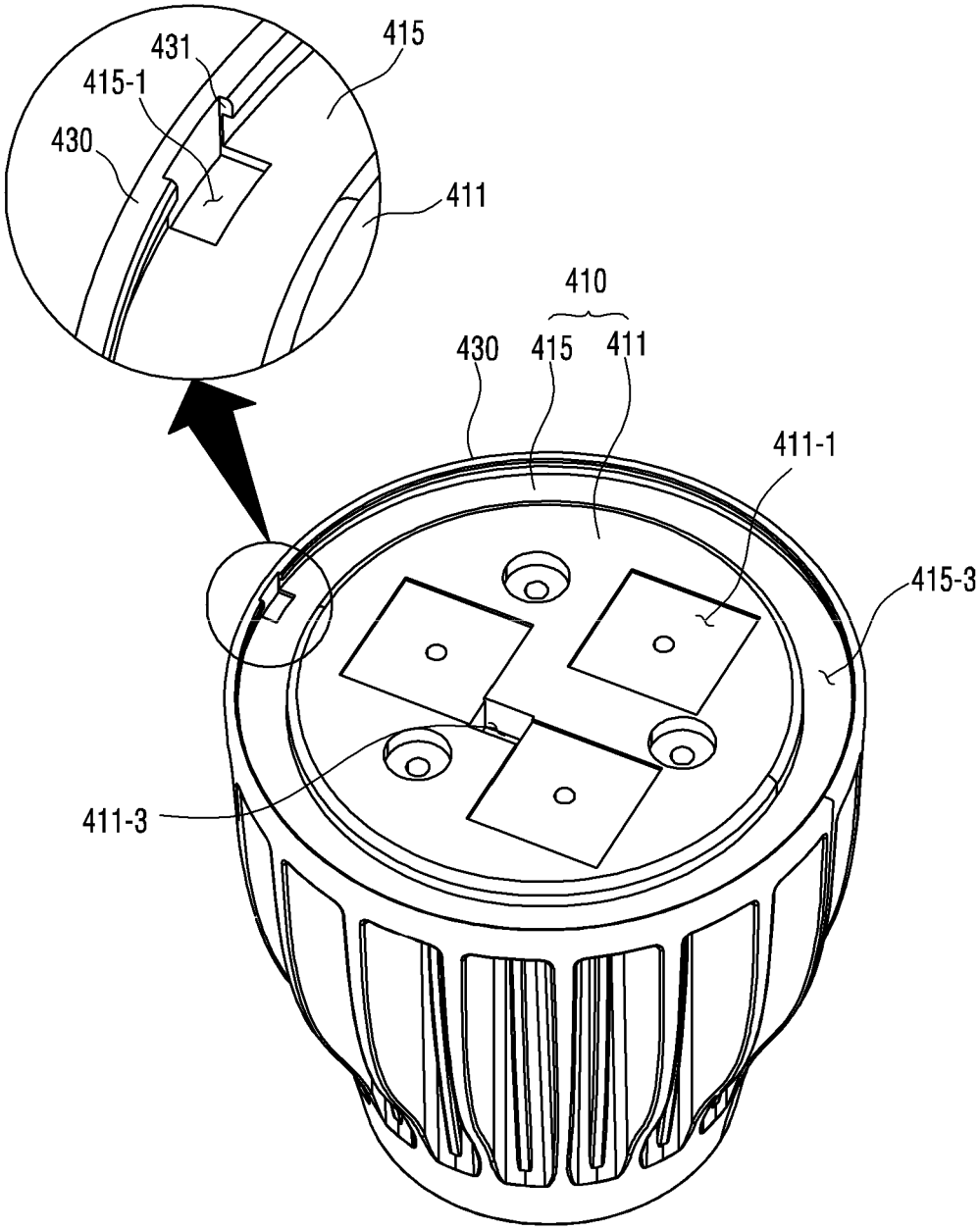
FIG. 5 is a perspective view of a heat sink shown in FIG. 3.

FIG. 4 is a perspective view of the cover 100 shown in FIG. 3. FIG. 5 is a perspective view of the heat sink 400 shown in FIG. 3.

Referring to FIG. 4, the cover 100 includes a coupler 110 for being coupled to the heat sink 400. The coupler 110 may be connected to the edge of the cover 100 or may project outwardly from the edge of the cover 100. Here, the edge of the cover 100 may define an open portion of the cover 100.

The coupler 110 may include a reference member 111, a connection member 113 and a hook 115.

At least one reference member 111 may be disposed at the edge of the cover 100.

The connection member 113 may be spaced apart from the reference member 111. A plurality of the connection members 113 may be disposed at the edge of the cover 100. Here, the plurality of the connection members 113 may be spaced apart from each other instead of being connected to each other.

The hook 115 is disposed on the connection member 113. Specifically, the hook 115 may be disposed on the outer surface of the connection member 113. Also, the hook 115 may project outwardly from the outer surface of the connection member 113. Here, the hook 115 may be disposed on a portion of the outer surface of the connection member 113, not on the entire outer surface of the connection member 113.

The cover 100 shown in FIG. 4 is coupled to the heat sink 400 shown in FIG. 5. A coupling structure between the cover 100 and the heat sink 400 is as follows. The reference member 111 of the coupler 110 is inserted into a reference recess 415-1. The connection member 113 of the coupler 110 contacts with a hitching sill 431 of a guide 430 of the heat sink 400. The hook 115 of the coupler 110 is disposed in a space below the hitching sill 431 of the guide 430 of the heat sink 400.

Since the cover 100 includes the reference member 111 and the heat sink 400 includes the reference recess 415-1, when the cover 100 is coupled to the heat sink 400, it is possible to easily check where the cover 100 and the heat sink 400 are coupled to each other. That is, it is possible to quickly check the direction in which the cover 100 is coupled to the heat sink 400. Also, after the cover 100 is coupled to the heat sink 400, the cover 100 can be prevented from moving, especially rotating.

In the coupling of the cover 100 and the heat sink 400, when the plurality of the connection members 113 of the cover 100 are disposed separately from each other, the plurality of the connection members 113 are able to maximally absorb tension caused by the hitching sill 431. If the connection members 113 are integrally formed, it is quite probable that the tension caused by the hitching sill 431 damages the integrally formed connection members 113.

The hook 115 of the cover 100 prevents the cover 100 from being separated from the heat sink 400 in a state where there is no external force. Here, the hook 115 may be disposed on a portion of the outer surface of the connection member 113. Here, in the coupling of the cover 100 and the heat sink 400, the tension caused by the hitching sill 431 where the hook 115 is disposed on a portion of the outer surface of the connection member 113 is less than that where the hook 115 is disposed on the entire outer surface of the connection member 113.

Referring back to FIGS. 1 to 3, the inner surface of the cover 100 may be coated with an opalescent pigment. The opalescent pigment may include a diffusing agent which diffuses light. A surface roughness of the inner surface of the cover 100 is larger than that of the outer surface of the cover 100. This intends to sufficiently scatter and diffuse light from the light source module 200 and to outwardly emit the light.

The cover 100 may include a light diffusion material.

The cover 100 may be formed of glass, plastic, polypropylene (PP), polyethylene (PE), polycarbonate (PC) and the like. Here, the polycarbonate (PC) has excellent light resistance, thermal resistance and rigidity. The cover 100 may be transparent such that the light source module 200 is visible to the outside, or may not be transparent. The cover 100 may be formed by a blow molding process.

The light source module 200 emits light and is disposed in the heat sink 400. Therefore, heat generated from the light source module 200 may be directly transferred to the heat sink 400.

The light source module 200 may include a light source unit 210, a connecting plate 230 and a connector 250. Specifically, this will be described with reference to FIG. 6.

Figure 6:
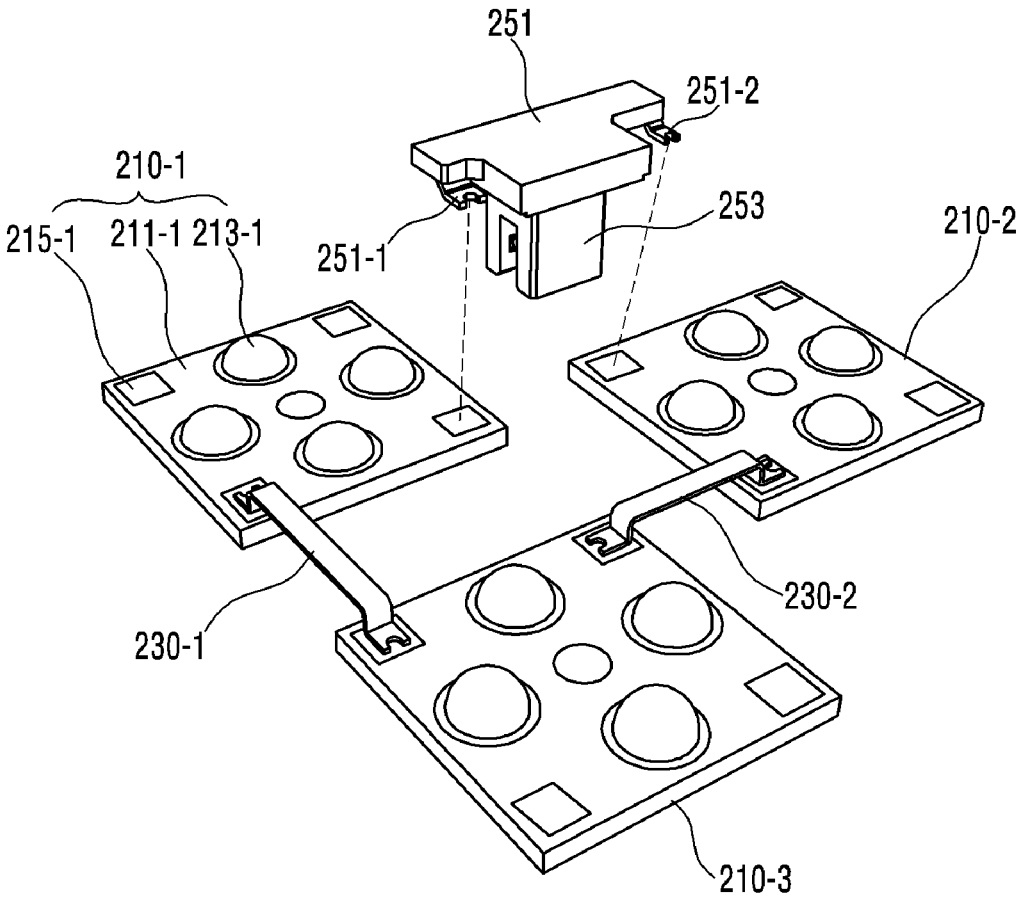
FIG. 6 is a perspective view of a light source module shown in FIG. 3.

FIG. 6 is a perspective view of a light source module 200 shown in FIG. 3.

Referring to FIGS. 3 and 6, the light source module 200 may include a first to a third light source units 210-1, 210-2 and 210-3, a first and a second connecting plates 230-1 and 230-2, and the connector 250.

The first light source unit 210-1 may include a substrate 211-1, a plurality of light emitting devices 213-1 and a pad 215-1. The plurality of the light emitting devices 213-1 are arranged symmetrically on the substrate 211-1. The plural pads 215-1 are disposed on the outer circumference of the substrate 211-1. Here, the pads 215-1 may be disposed in each corner of the substrate 211-1.

The substrate 211-1 may be formed by printing a circuit pattern on an insulator. For example, the substrate 211-1 may include a general printed circuit board (PCB), a metal core PCB, a flexible PCB, a ceramic PCB and the like.

The surface of the substrate 211-1 may be coated with a material which efficiently reflects light or may have a color capable of efficiently reflecting light, for example, white, silver and the like.

The light emitting device 213-1 may be a light emitting diode chip emitting red, green and blue light or a light emitting diode emitting ultraviolet light. Here, the light emitting diode may have a lateral type or a vertical type. The light emitting diode may emit blue, red, yellow or green light.

The light emitting device 213-1 may further include a lens. The lens may be disposed to cover the light emitting device 213-1. The lens is able to adjust the orientation angle of light emitted from the light emitting device 213-1 or the direction of the light. The lens has a hemispherical shape. The lens may have no empty space and may be formed of a light-transmitting resin such as a silicon resin or epoxy resin. The light-transmitting resin may include wholly or partially distributed fluorescent material.

When the light emitting device 213-1 is a blue light emitting diode, the fluorescent material included in the light-transmitting resin may include at least one of a garnet fluorescent material (YAG, TAG), a silicate fluorescent material, a nitride fluorescent material and an oxynitride fluorescent material.

Although natural light can be created by including only a yellow fluorescent material in the light-transmitting resin, a green or red fluorescent material may be further included in order to improve a color rendering index and to reduce color temperature.

When various kinds of the fluorescent materials are mixed in the light-transmitting resin, an addition ratio of the color of the fluorescent material may be formed such that the green fluorescent material is more used than the red fluorescent material, and the yellow fluorescent material is more used than the green fluorescent material. The YAG material of the garnet fluorescent material, silicate fluorescent material and oxynitride fluorescent material may be used as the yellow fluorescent material. The silicate fluorescent material and oxynitride fluorescent material may be used as the green fluorescent material. The nitride fluorescent material may be used as the red fluorescent material. The light-transmitting resin may be mixed with various kinds of the fluorescent materials or may be configured by a layer including the red fluorescent material, a layer including the green fluorescent material and a layer including the yellow fluorescent material, which are formed separately from each other.

The pads 215-1 may be disposed in each corner of the substrate 211-1. The pad 215-1 is electrically connected to the light emitting device 213-1 through the substrate 211-1. When the connecting plate 230 and the connector 250 are connected to the pad 215-1, a power signal from the power supplier 600 shown in FIG. 3 is transmitted to the light emitting device 213-1.

Since the second and the third light source units 210-2 and 210-3 are the same as the first light source unit 210-1, a detailed description thereof will be omitted.

The first connecting plate 230-1 electrically connects the first light source unit 210-1 and the third light source unit 210-3. One end of the first connecting plate 230-1 is electrically connected to the pad 215-1 of the first light source unit 210-1. The other end of the first connecting plate 230-1 is electrically connected to the pad of the third light source unit 210-3. The first light source unit 210-1 and the third light source unit 210-3 may be connected in series by the first connecting plate 230-1.

The second connecting plate 230-2 electrically connects the second light source unit 210-2 and the third light source unit 210-3. One end of the second connecting plate 230-2 is electrically connected to the pad of the second light source unit 210-2. The other end of the second connecting plate 230-2 is electrically connected to the pad of the third light source unit 210-3. The second light source unit 210-2 and the third light source unit 210-3 may be connected in series by the second connecting plate 230-2.

The first and the second connecting plates 230-1 and 230-2 include an electrically conductive material. The material may have its own electrical conductivity, for example, a metallic material.

The middle portions of the first and the second connecting plates 230-1 and 230-2 may have a plate shape elongated in one direction. The contacting portion of the connecting plate, which is placed at both ends of the connecting plate and contacts with the pad of the light source unit 210, may have a shape of which the middle portion is curved inwardly.

The connector 250 transmits the power signal supplied from the power supplier 600 shown in FIG. 3 to the first and the second light source units 210-1 and 210-2.

The connector 250 includes a first connection member 251 and a second connection member 253.

The first connection member 251 includes a first contacting part 251-1 and a second contacting part 251-2. The first contacting part 251-1 is electrically connected to the pad 215-1 of the first light source unit 210-1. The second contacting part 251-2 is electrically connected to the pad of the second light source unit 210-2.

The second connection member 253 has a shape which is connected to one side of the first connection member 251 or projects outwardly from one side of the first connection member 251. The second connection member 253 is directly electrically connected to the power supplier 600 shown in FIG. 3. Specifically, this will be described with reference to FIG. 7.

Figure 7:
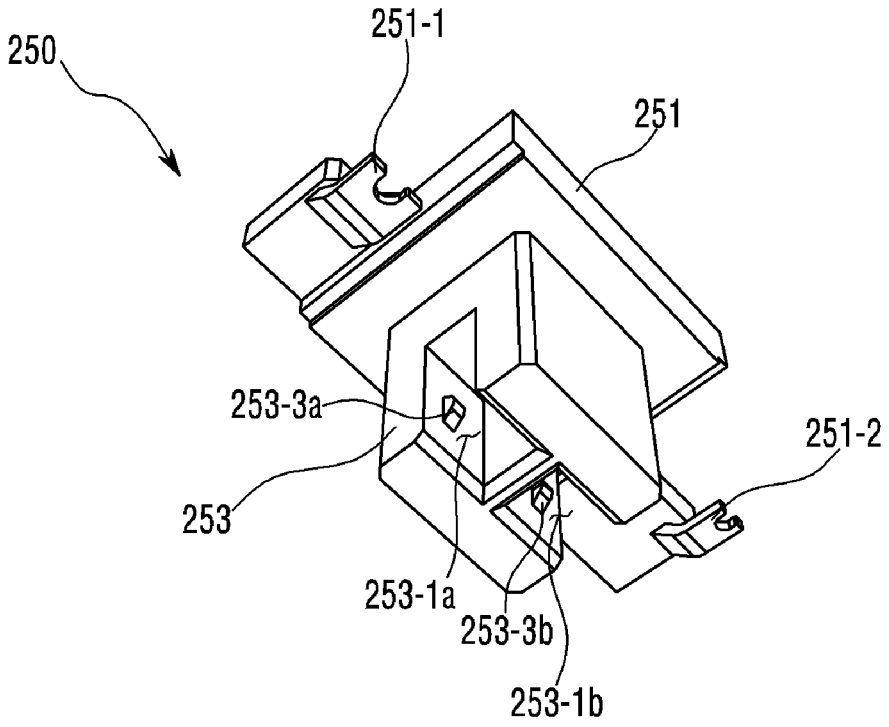
FIG. 7 is a bottom perspective view of a connector shown in FIG. 6.

FIG. 7 is a bottom perspective view of the connector 250 shown in FIG. 6.

Referring to FIGS. 6 and 7, the second connection member 253 includes a first recess 253-1*a*, a second recess 253-1*b*, a first connection portion 253-3*a* and a second connection portion 253-3*b*.

A projection 610 of the power supplier 600 shown in FIG. 3 is inserted into the first recess 253-1*a* and the second recess 253-1*b*. The first connection portion 253-3*a* and the second connection portion 253-3*b* physically and electrically contacts with the electrode plate of the projection 610 of the power supplier 600 shown in FIG. 3. When the first connection portion 253-3*a* and the second connection portion 253-3*b* physically and electrically contacts with the electrode plate of the projection 610 of the power supplier 600 shown in FIG. 3, the first connection portion 253-3*a* and the second connection portion 253-3*b* may be pushed into the inside of the second connection member 253. Meanwhile, when the electrode plate of the projection 610 of the power supplier 600 shown in FIG. 3 is separated from the first connection portion 253-3*a* and the second connection portion 253-3*b*, the first and the second connection portions 253-3*a* and 253-3*b* may project from the inside of the second connection member 253 to the first recess 253-1*a* and the second recess 253-1*b*.

The first contacting part 251-1 of the first connection member 251 is electrically connected to the first connection portion 253-3*a* of the second connection member 253. The second contacting part 251-2 of the first connection member 251 is electrically connected to the second connection portion 253-3*b* of the second connection member 253. Here, the first and the second contacting parts 251-1 and 251-2 of the first connection member 251 may be integrally formed with the first and the second connection portions 253-3*a* and 253-3*b* of the second connection member 253 instead of being separately formed. In other words, the first contacting part 251-1 of the first connection member 251 and the first connection portion 253-3*a* of the second connection member 253 may be integrally included within the connector 250. The second contacting part 251-2 of the first connection member 251 and the second connection portion 253-3*b* of the second connection member 253 may be integrally included within the connector 250.

The electrical signal from the power supplier 600 may be transmitted to the light emitting devices 213-1 of the first to the third light source units 210-1, 210-2 and 210-3 by the pads 215-1 of the first to the third light source units 210-1, 210-2 and 210-3, the first and the second connecting plates 230-1 and 230-2 and the connector 250. As such, the lighting device according to the embodiment does not use a wire in the transmission of the electrical signal from the power supplier 600 to the light emitting device 213-1. Therefore, optical loss caused by the wire can be removed. Since the wire is not used, the lighting device according to the embodiment can be easily assembled and does not require an additional process such as a soldering process, so that work efficiency can be improved.

The light source module 200 can be implemented without the third light source unit 210-3. That is, the light source module 200 can be implemented by the first and the second light source units 210-1 and 210-2, one connecting plate 230 and one connector 250. Also, the light source module 200 can be implemented by using four or more light source units 210. In this case, the number of the connecting plates 230 is 1 less than the number of the light source unit 210.

The member 300 will be described with reference again to FIG. 3.

The member 300 is disposed on the heat sink 400 and includes a guide recess 310 into which the plurality of the light source units 210 and the connector 250 are inserted.

The guide recess 310 may have a shape corresponding to the shapes of the light source unit 210 and the connector 250.

A light reflective material may be applied to or coated on the surface of the member 300. For example, a white pigment may be applied to or coated on the surface of the member 300. With regard to light which returns to the light source module 200 after being reflected by the inner surface of the cover 100, the member 300 may reflect the light again toward the cover 100. Therefore, light-extraction efficiency of the lighting device according to the embodiment can be improved.

The member 300 may have electrical insulation. The connecting plate 230 of the light source module 200 includes an electrical conductive material. Therefore, electrical contact may be formed between the heat sink 400 and the connecting plate 230. The member 300 is disposed between the heat sink 400 and the connecting plate 230, and is comprised of an insulating material. The member 300 is hereby able to prevent electrical short-cut between the connecting plate 230 and the heat sink 400.

The heat sink 400 receives heat from the light source module 200 and the power supplier 600 and radiates the heat. This will be described in detail with reference to FIGS. 5, 8 and 9.

Figure 8:
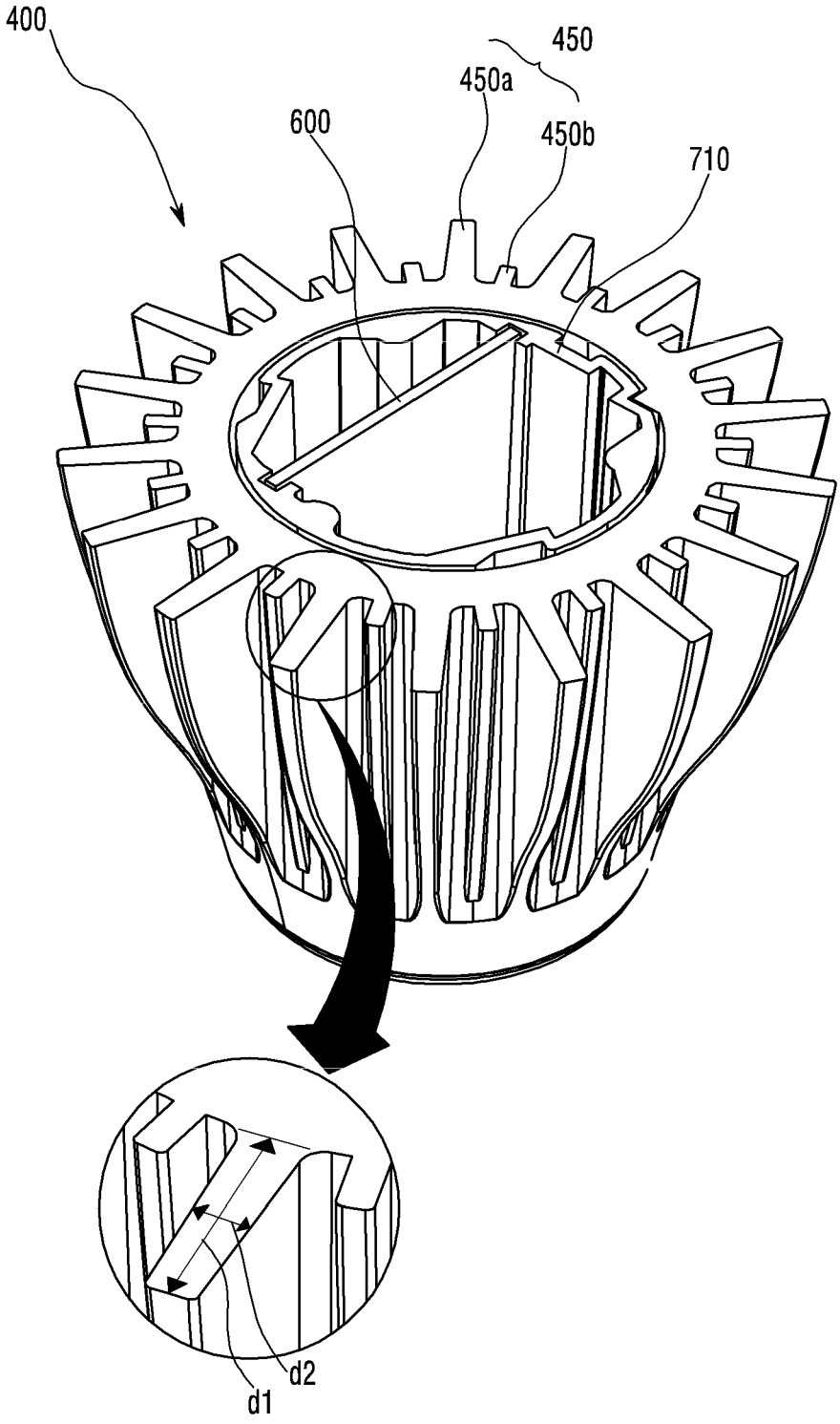
FIG. 8 is a cross sectional view of the lighting device shown in FIG. 1.
Figure 9:
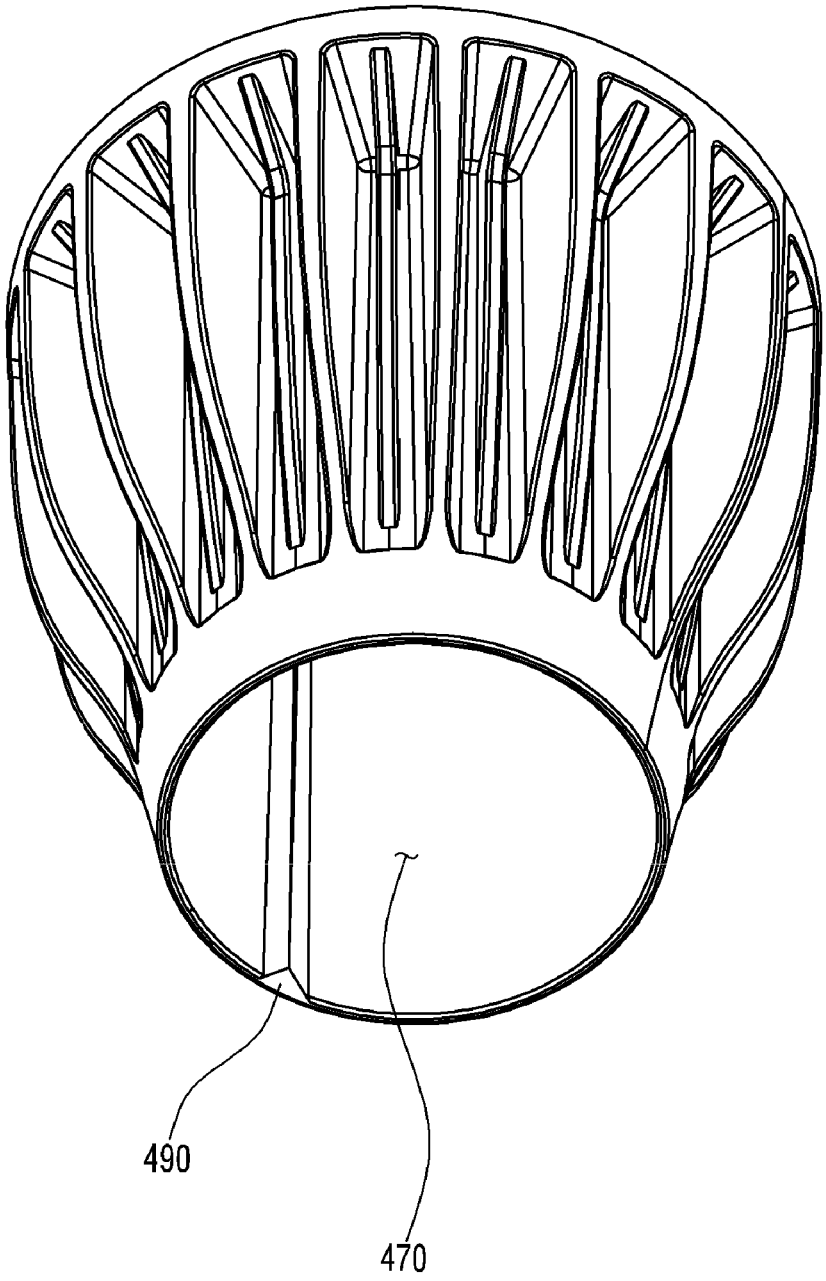
FIG. 9 is a bottom perspective view of the heat sink shown in FIG. 3.

FIG. 5 is a perspective view of a heat sink shown in FIG. 3. FIG. 8 is a cross sectional view of the lighting device shown in FIG. 1. FIG. 9 is a bottom perspective view of the heat sink shown in FIG. 3.

Referring to FIGS. 5, 8 and 9, the heat sink 400 includes a top surface 410 on which the light source module 200 is disposed, the guide 430 guiding the cover 100, a heat radiating fin 450, a receiving recess 470 receiving the power supplier, and a guiding member 490.

The top surface 410 may include a projecting surface 411 and a base surface 415.

The projecting surface 411 projects upward on the basis of the base surface 415 and has a predetermined level difference with respect to the base surface 415. The projecting surface 411 may include a seating recess 411-1 in which the light source units 210 of the light source module 200 are disposed. The seating recess 411-1 may have a shape corresponding to the substrate of the light source unit 210. Also, the projecting surface 411 includes a hole 411-3 into which the connector 250 of the light source module 200 is inserted.

The base surface 415 is disposed between the projecting surface 411 and the guide 430. The base surface may corresponding to the bottom surface of a groove 415-3 formed between the projecting surface 411 and the guide 430. The coupler 110 of the cover 100 shown in FIG. 4 is inserted into the groove 415-3.

The base surface 415 includes the reference recess 415-1 into which the reference member 111 of the cover 100 is inserted. Through the reference recess 415-1, it is possible to check where the cover 100 is coupled to the heat sink 400.

The guide 430 may be connected to or extend from the outer circumference of the base surface 415. The guide 430 guides the coupler 110 of the cover 100 shown in FIG. 4. The guide 430 includes the hitching sill 431 which is coupled to the hook 115 of the cover 100 shown in FIG. 4.

The heat radiating fin 450 may be connected to the lateral surface excluding the top surface 410 and the bottom surface of the heat sink 400, or extend outwardly from the lateral surface of the heat sink 400. The heat radiating fin 450 is able to improve heat radiation efficiency by increasing the radiating heat area of the heat sink 400.

The heat radiating fin 450 includes a first heat radiating fin 450*a* and a second heat radiating fin 450*b*.

The volume of the first heat radiating fin 450*a* is greater than that of the second heat radiating fin 450*b*.

Specifically, the thickness "d2" of the first heat radiating fin 450*a* is larger than that of the second heat radiating fin 450*b*. The height "d1" of the first heat radiating fin 450*a* is greater than that of the second heat radiating fin 450*b*. Here, the height "d1" of the first heat radiating fin 450*a* means an outward length from the lateral surface of the heat sink 420.

From the viewpoint of the lateral surface of the heat sink 400, the heights of the first and the second heat radiating fins 450*a* and 450*b* are reduced toward the bottom surface from the top surface of the heat sink 400. The height "d1" of the first heat radiating fin 450*a* may be equal to or greater than 7 mm and equal to or less than 12 mm. The thickness "d2" of the first heat radiating fin 450*a* may be equal to or larger than 1 mm and equal to or less than 2 mm. Preferably, the height "d1" of the first heat radiating fin 450*a* may be 10 mm and the thickness "d2" of the first heat radiating fin 450*a* may be 1.5 mm.

The thickness "d2" of the first heat radiating fin 450*a* may be, as shown in FIG. 9, reduced toward the bottom surface from the top surface of the heat sink 400. In this case, two mutually facing sides of the first heat radiating fin 450*a* become closer to each other toward the bottom surface from the top surface of the heat sink 400. Here, an angle between the two sides of the first heat radiating fin 450*a* may be equal to or greater than 1.degree and equal to or less than 1.5.degree. Preferably, the angle between the two sides of the first heat radiating fin 450*a* may be 1.2.degree. When the thickness "d2" of the first heat radiating fin 450*a* is reduced toward the bottom surface from the top surface of the heat sink 400 or when the angle between the two sides of the first heat radiating fin 450*a* is equal to or greater than 1.degree and equal to or less than 1.5.degree, it is easy to mold the heat sink 400.

A plurality of the first heat radiating fins 450*a* are disposed separately from each other on the lateral surface of the heat sink 400. A plurality of the second heat radiating fins 450*b* are disposed separately from each other on the lateral surface of the heat sink 400. The first heat radiating fin 450*a* and the second heat radiating fin 450*b* are alternately disposed on the lateral surface of the heat sink 400. That is, the second heat radiating fin 450*b* is disposed between the two first heat radiating fins 450*a*, and the first heat radiating fin 450*a* is disposed between the two second heat radiating fins 450*b*. An interval between the first heat radiating fin 450*a* and the second heat radiating fin 450*b* may be equal to or greater than 1 mm and equal to or less than 3 mm. Here, the interval between the first heat radiating fin 450*a* and the second heat radiating fin 450*b* may be 2 mm.

When the heat sink 400 includes the first heat radiating fin 450*a* and the second heat radiating fin 450*b*, this is advantageous to a molding process, a coating process and the like in the manufacture of the heat sink 400 and heat radiation efficiency can be improved. If the heat sink 400 includes only the first heat radiating fin 450*a* without the second heat radiating fin 450*b*, it is difficult to perform the molding process and the coating process in the manufacture of the heat sink 400. Contrary to this, when the heat sink 400 includes only the second heat radiating fin 450*b*, the radiating heat area of the heat sink 400 becomes smaller.

The receiving recess 470 has a shape dug from the bottom surface toward the top surface 410 of the heat sink 400. The receiving recess 470 receives the holder 500, the power supplier 600 and the inner case 700.

The guiding member 490 is disposed on the inner surface of the heat sink 400, which defines the receiving recess 470. When the inner case 700 is received in the receiving recess 470 of the heat sink 400, the guiding member 490 determines where the inner case 700 is received. Therefore, assemblage work efficiency can be improved. The inner case 700 includes a guide recess corresponding to the guiding member 490. The guide recess will be described in FIG. 12.

The holder 500 will be described with reference again to FIG. 3.

The holder 500, together with the inner case 700, covers the power supplier 600. Specifically, this will be described with reference to FIG. 10.

Figure 10:
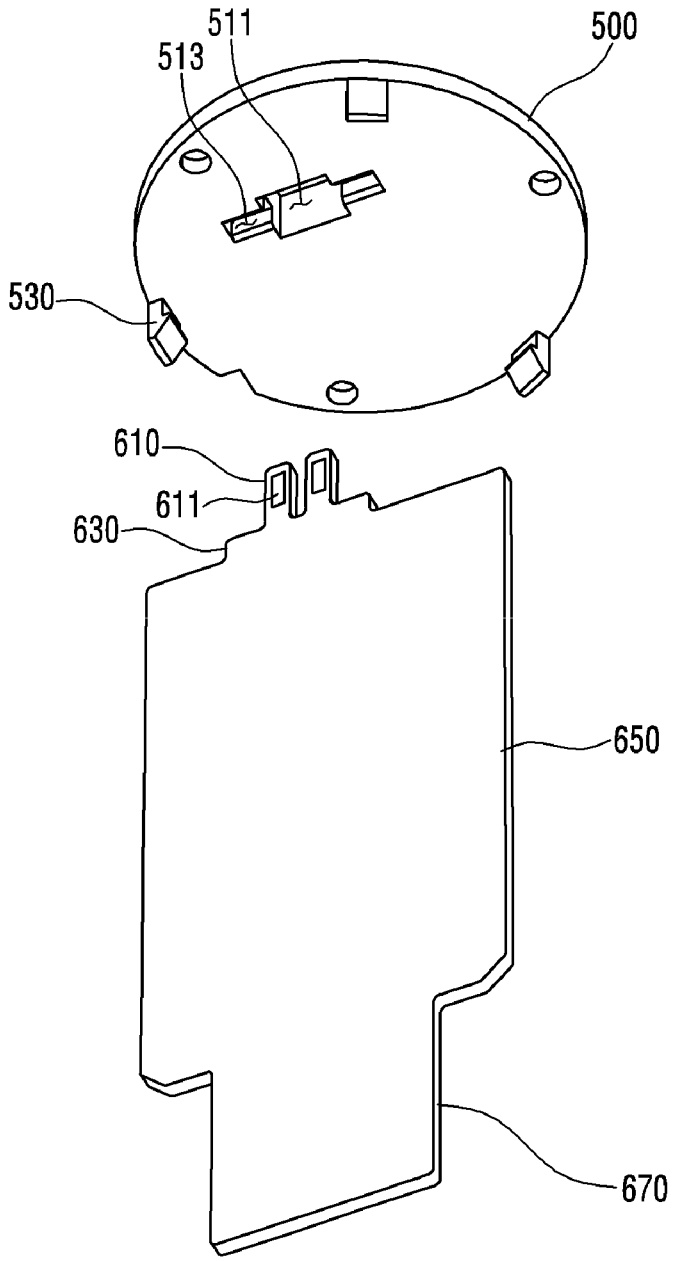
FIG. 10 is a bottom perspective view of a holder and a power supplier, all of which are shown in FIG. 3.

FIG. 10 is a bottom perspective view of the holder 500 and the power supplier 600, all of which are shown in FIG. 3.

Referring to FIGS. 3 and 10, the holder 500 is disposed in a receiving recess 719 of an insulating portion 710 of the inner case 700. Therefore, the power supplier 600 received in the insulating portion 710 of the inner case 700 is covered.

The holder 500 includes a guide projection 510. The guide projection 510 includes a hole 511 through which the projection 610 of the power supplier 600 passes.

The guide projection 510 is coupled to a groove (not shown) formed on the bottom surface of the receiving recess 470 of the heat sink 400 shown in FIG. 9. Here, the top surface of the heat sink 400 and the bottom surface face each other.

The holder 500 may include a hook 530 for being coupled to the inner case 700. A plurality of the hooks 530 may be provided. The holder 500 may be fixed to the inner case 700 by the hook 530.

The power supplier 600 will be described with reference again to FIG. 3.

The power supplier 600 processes or converts the electrical signal supplied from outside and provided the electrical signal to the light source module 200. The power supplier 600 is received in the receiving recess 719 of the inner case 700 and is sealed inside the inner case 700 by the holder 500.

The power supplier 600 may include the projection 610, a guide 630, a base 650 and an extension part 670. This will be described with reference to FIGS. 10 and 11.

Figure 11:
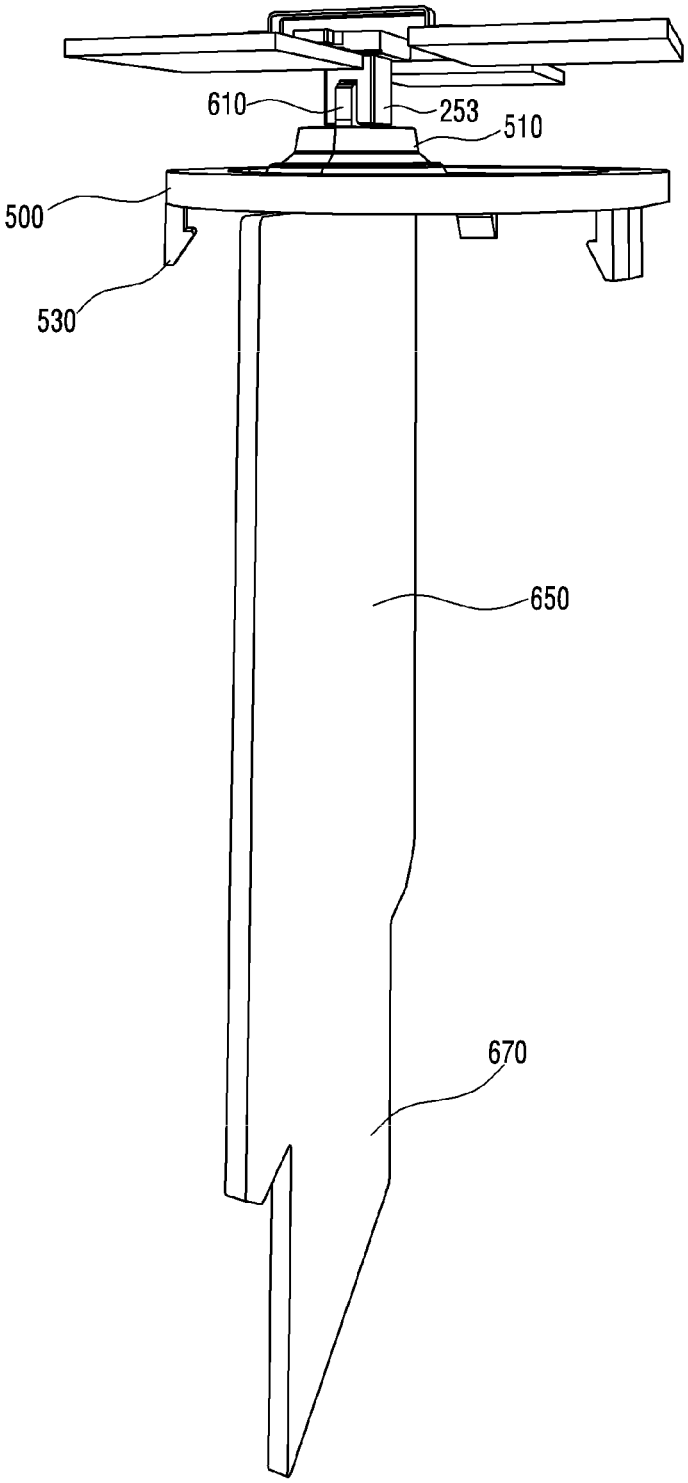
FIG. 11 is a perspective view showing a coupling structure among the light source module, the holder and the power supplier, all of which are shown in FIG. 3.

FIG. 10 is a bottom perspective view of the holder 500 and the power supplier 600, all of which are shown in FIG. 3. FIG. 11 is a perspective view showing a coupling structure among the light source module 200, the holder 500 and the power supplier 600, all of which are shown in FIG. 3.

Referring to FIGS. 10 and 11, the projection 610 has a shape projecting outwardly from the guide 630. The projection 610 passes through the hole 511 of the holder 500 and is inserted into the first recess 253-1*a* and the second recess 253-1*b* of the second connection member 253 of the connector 250, which are shown in FIGS. 6 and 7. The projection 610 includes an electrode plate 611. The electrode plate 611 electrically contacts with the first connection portion 253-3*a* and the second connection portion 253-3*b* of the connector 250, which are shown in FIGS. 6 and 7. A remaining portion of the projection 610 other than the electrode plate 611 may be formed of an insulation material.

The guide 630 has a shape projecting outwardly from one side of the base 650. The guide 630 is inserted into a guide recess 513 of the holder 500. When the guide 630 is inserted into the guide recess 513, the power supplier 600 can be securely coupled to the holder 500. The guide recess 513 may comprise a guide groove.

Plural parts (not shown) are disposed on one side of the base 650. The plural parts may include, for example, a DC converter converting AC power supply supplied by an external power supply into DC power supply, a driving chip controlling the driving of the light source module 200 and an electrostatic discharge (ESD) protective device for protecting the light source module 200. However, there is no limit to the plural parts.

The extension part 670 has a shape projecting outwardly from the other side of the base 650. The extension part 670 is inserted into the inside of a connecting portion 750 of the inner case 750 and receives an electrical signal from outside. Therefore, the width of the extension part 670 is equal to or less than that of the connecting portion 750 of the inner case 750.

One end of each of a + wire (not shown) and a − wire (not shown) is electrically connected to the extension part 670. The other end of each of the + wire (not shown) and the − wire (not shown) is electrically connected to the socket 800.

The inner case 700 will be described with reference again to FIG. 3.

The power supplier 600 is received within the inner case 700. The inner case 700 is inserted into the receiving recess 470 shown in FIG. 9 of the heat sink 400. The inner case 700 is disposed between the power supplier 600 and the heat sink 400 and electrically insulates the power supplier 600 from the heat sink 400.

The inside of the inner case 700 includes not only the power supplier 600 but also a molding part (not shown). The molding part (not shown) is formed by solidifying a molding liquid and causes the power supplier 600 to be fixed inside the inner case 700.

The inner case 700 may include the insulating portion 710, a supporter 730, the connecting portion 750, a packing 770 and a projection 790. This will be described in detail with reference to FIGS. 12, 13 and 14.

Figure 12:
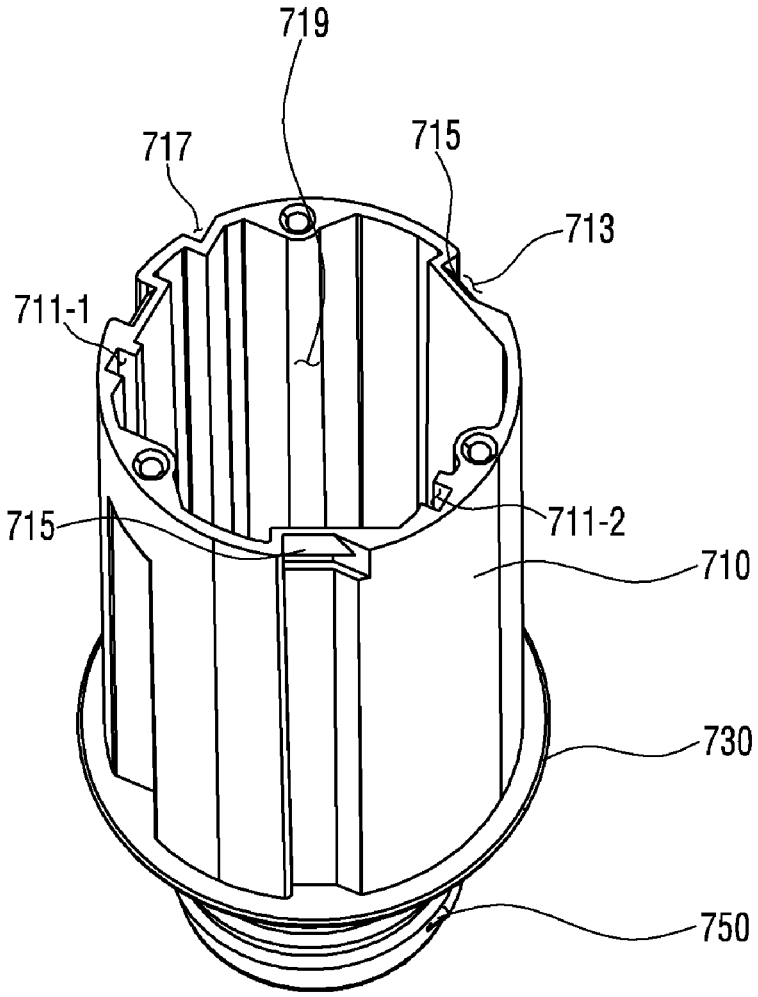
FIG. 12 is a perspective view of an inner case shown in FIG. 3.
Figure 13:
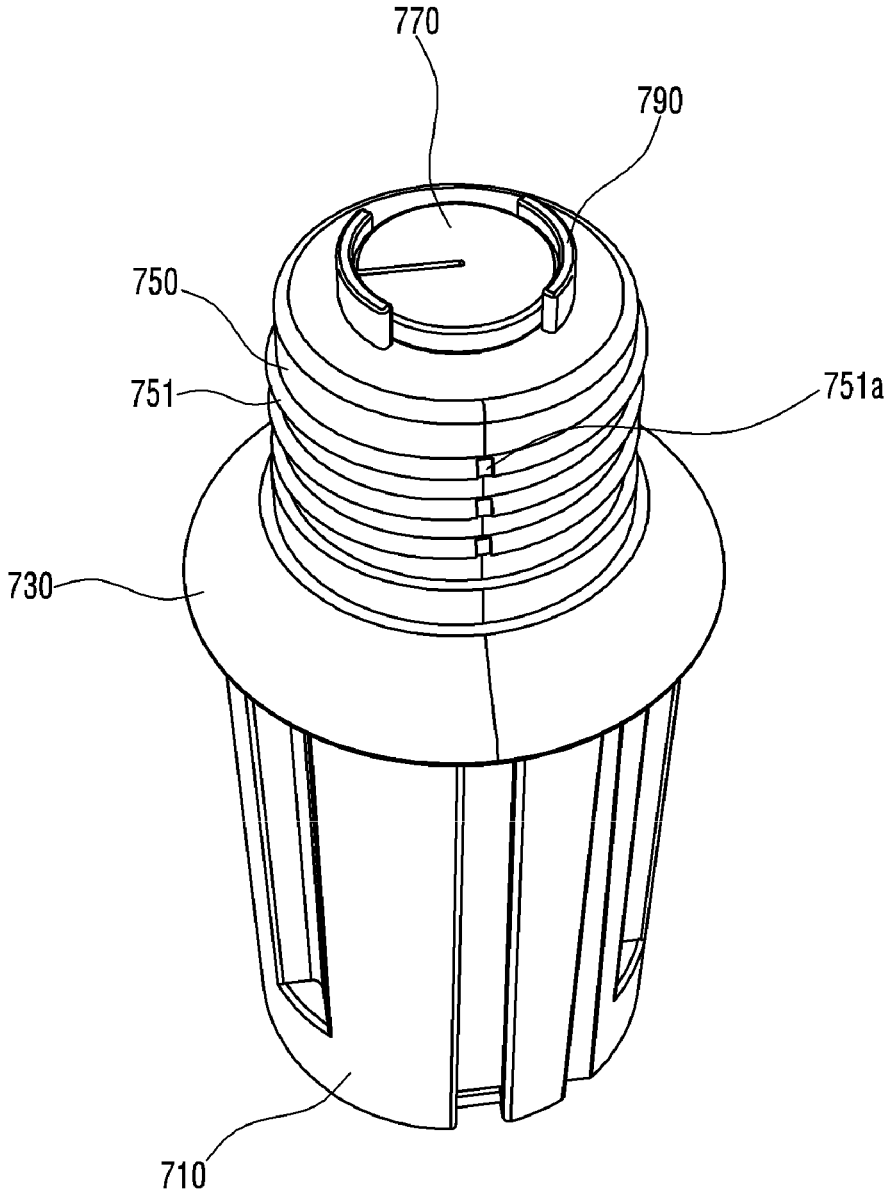
FIG. 13 is a perspective view of the inner case shown in FIG. 3 which is turned upside down.
Figure 14:
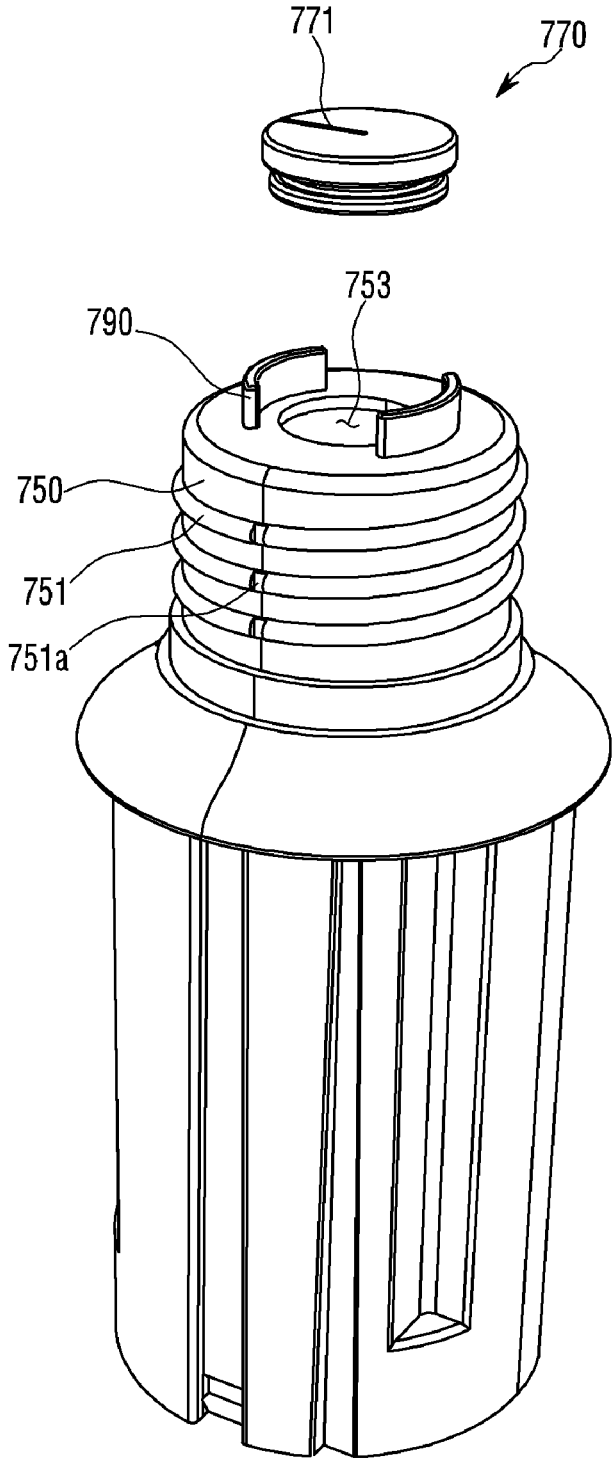
FIG. 14 is an exploded perspective view of the inner case shown in FIG. 13.

FIG. 12 is a perspective view of an inner case shown in FIG. 3. FIG. 13 is a perspective view of the inner case shown in FIG. 3 which is turned upside down. FIG. 14 is an exploded perspective view of the inner case shown in FIG. 13.

The insulating portion 710 has a cylindrical shape. The inside of the insulating portion 710 includes the receiving recess 719 for receiving the power supplier 600.

The inner surface of the insulating portion 710 includes grooves 711-1 and 711-2 which guide both sides of the base 650 shown in FIG. 11 of the power supplier 600.

The outer surface of the insulating portion 710 includes a groove 713 into which the hook 530 shown in FIG. 10 of the holder 500 is inserted. The number of the grooves 713 corresponds to the number of the hooks 530 of the holder 500. Therefore, the number of the grooves 713 in the drawing is 3.

The outer surface of the insulating portion 710 includes a hitching sill 715 by which the hook 530 shown in FIG. 10 of the holder 500 is hitched. The hitching sill 715 is disposed inside the groove 713 of the insulating portion 710.

The outer surface of the insulating portion 710 includes a guide recess 717 into which the guiding member 490 shown in FIG. 9 of the heat sink 400 is inserted. The guide recess 717 may comprise a guide groove.

The supporter 730 is disposed between the insulating portion 710 and the connecting portion 750. The supporter 730 contacts with the bottom surface of the heat sink 400 shown in FIG. 9.

The connecting portion 750 is connected to the socket 800 shown in FIG. 3. The connecting portion 750 includes a screw thread 751 corresponding to a screw recess of the socket 800. The socket 800 is coupled to the inner case 700 by the screw thread 751 and the screw recess of the socket 800. The screw recess may comprise a screw groove.

The screw thread 751 of the connecting portion 750 includes a plurality of cavities 751*a*. The + wire of which one end is connected to the extension part 670 shown in FIG. 11 of the power supplier 600 is inserted into the cavities 751*a*. For this purpose, the plurality of the cavities 751*a* are arranged adjacently in order that the + wire is inserted. When the inner case 700 is coupled to the socket 800, the plurality of the cavities 751*a* of the connecting portion 750 is able to prevent the movement and damage of + wire caused by the rotary coupling of the socket 800.

The connecting portion 750 includes an opening 753 into which the molding liquid is injected. The molding liquid is solidified and becomes the molding part (not shown). The molding part (not shown) functions to fix the power supplier 600.

The packing 770 blocks the opening 753 of the connecting portion 750. The packing 770 may be formed of a flexible material such as rubber or synthetic resins. After the power supplier 600 is received within the inner case 700 and the molding liquid is filled in the inner case 700, the packing 770 prevents the molding liquid from flowing out until the molding liquid filled in the inner case 700 is solidified and becomes the molding part (not shown).

The packing 770 includes a gap 771. This will be described in detail with reference to FIG. 15.

Figure 15:
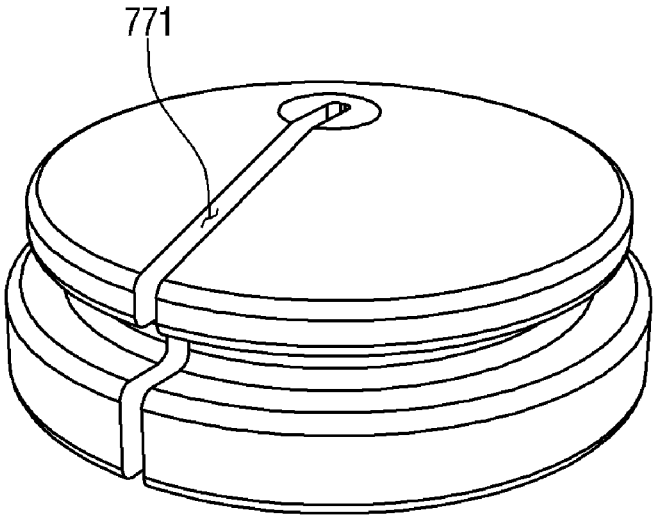
FIG. 15 is a perspective view of a packing shown in FIG. 14 which is turned upside down.

FIG. 15 is a perspective view of the packing 770 shown in FIG. 14 which is turned upside down.

The gap 771 is a predetermined narrow space formed by deeply digging or widening a portion of the outer circumference of the packing 770 in the internal direction of the packing 770. When the packing 770 is inserted and fixed into the opening 753 of the connecting portion 750, the gap 771 becomes smaller or disappears.

The – wire of which one end is connected to the extension part 670 shown in FIG. 11 of the power supplier 600 is disposed in the gap 771. When the – wire is inserted into the gap 771 and the packing 770 is inserted and fixed into the opening 753 of the connecting portion 750, the gap 771 becomes narrower to press and securely fix the – wire. Accordingly, the molding liquid filled in the inner case 700 cannot flow out through the gap 771.

Referring to FIGS. 13 and 14, the projection 790 has a shape which is connected to or projects outwardly from the connecting portion 750. Specifically, the projection 790 projects in the direction in which the inner case 700 is coupled to the socket 800 shown in FIG. 3. The projection 790 may be disposed around the opening 753 of the connecting portion 750. This is because the socket 800 is the most damaged when the connecting portion 750 is coupled to the socket 800.

The projection 790 is formed, as shown in FIG. 13, higher than the packing 770. The projection 790 is able to prevent the damage of the socket 800, for example, crush of the socket 800 in the fixing of the socket 800 shown in FIG. 3 to the connecting portion 750.

The socket 800 will be described with reference again to FIG. 3.

The socket 800 is connected to the connecting portion 750 of the inner case 700. The socket 800 may have the same structure as that of a conventional incandescent bulb. External electric power is transferred to the lighting device according to the embodiment through the socket 800. The socket 800 includes the screw groove corresponding to the screw thread of the connecting portion 750.

Hereafter, an assembly process of the lighting device according to the embodiment will be described with reference to FIG. 3.

The light source module 200 is assembled by using the three light source units 210, the two connecting plates 230 and the connector 250.

The power supplier 600 is inserted into the receiving recess 719 of the insulating portion 710 of the inner case 700. Here, the + wire and the – wire of the power supplier 600 are allowed to come out of the opening of the connecting portion 750 of the inner case 700. In order to block the receiving recess 719 of the insulating portion 710 of the inner case 700, the holder 500 is coupled to the inner case 700.

The molding liquid is injected into the inner case 700, and then the opening 753 of the connecting portion 750 is, as shown in FIG. 13, blocked by the packing 770. Here, the – wire is inserted into the gap 771 of the packing 770. The + wire is inserted and fixed into the plurality of the cavities 751*a* of the connecting portion 750.

The socket 800 is coupled to the connecting portion 750 of the inner case 700, and then the inner case 700 is inserted into the receiving recess 470 shown in FIG. 9 of the heat sink 400. Here, the guiding member 490 of the heat sink 400 is inserted and fixed into the guide recess 717 shown in FIG. 12 of the inner case 700.

The member 300 is disposed in the heat sink 400, and then the previously assembled light source module 200 is disposed in accordance with the guide recess 310 of the member 300. Here, the projection 610 of the power supplier 600 is inserted into the connector 250. Then, the light source module 200 is fixed to the heat sink 400 by using a fastening means such as a screw coupled to a hole h2 of the light source module 200 and a hole h2' of the heat sink 400.

The projection 610 of the power supplier 600 is inserted into the hole 411-3 of the heat sink 400, so that projection 610 is physically and electrically connected to the connector 250.

The member 300, the heat sink 400, the holder 500 and the inner case 700 are fixed by using a fastening means such as a screw coupled to a hole h1 of the member 300, a hole h1' of the heat sink 400, a hole h1" of the holder 500 and a hole h1'" of the inner case 700.

Lastly, the cover 100 is coupled to the heat sink 400.

The structure of the lighting device according to the embodiment allows the lighting device to be substituted for a conventional incandescent bulb. Therefore, it is possible to use equipments for the conventional incandescent bulb without the use of a mechanical connection structure for a new lighting device or without the improvement of assembly.

Technical Problem

An embodiment provides a lighting device capable of checking where a cover is coupled to a heat sink.

The embodiment provides a lighting device capable of preventing the cover from rotating.

The embodiment provides a lighting device capable of improving an optical efficiency.

The embodiment provides a lighting device requiring no wire in electrically connecting a plurality of light source units to each other.

The embodiment provides a lighting device capable of improving a heat radiation efficiency.

The embodiment provides a lighting device having advantages in an operation process.

The embodiment provides a lighting device in which a wire is not used between a power supplier and the light source unit.

The embodiment provides a lighting device which is easy to assemble.

The embodiment provides a lighting device of which the power supplier is stably fixed.

The embodiment provides a lighting device capable of preventing liquid which molds the power supplier from flowing out.

The embodiment provides a lighting device capable of preventing a wire which connects the power supplier with a socket from being damaged.

The embodiment provides a lighting device capable of preventing the wire which connects the power supplier with the socket from moving.

The embodiment provides a lighting device capable of preventing the socket from being damaged.

Technical Solution

A lighting device is provided to include a heat sink which includes a receiving recess and a top surface including a hole; a light source module which includes a substrate disposed on the heat sink, a light emitting device disposed on the substrate and a pad disposed on the substrate; a power supplier which is disposed in the receiving recess of the heat sink and includes a projection outputting a power signal for driving the light source module; and a connector which is coupled to the hole of the heat sink, includes a contacting part electrically connected to the pad of the light source module, and is electrically connected to the projection of the power supplier.

The connector includes a recess to which the projection of the power supplier is coupled and a connection portion which is disposed in the recess and is electrically connected to the contacting part. The projection of the power supplier includes an electrode plate which outputs the power signal and is connected to the connection portion.

The light source module includes: a first light source unit which includes a first substrate, a first light emitting device and a first and a second pads; a second light source unit which includes a second substrate, a second light emitting device and a third and a fourth pads; a connecting plate which electrically connects the first pad of the first light source unit and the third pad of the second light source unit; and a connector which includes a first contacting part and a second contacting part. The first contacting part receives a first power signal and is electrically connected to the second pad of the first light source unit. The second contacting part receives a second power signal and is electrically connected to the fourth pad of the second light source unit.

The connecting plate includes a middle portion, a first contacting part and a second contacting part. The first contacting part is electrically connected to the first pad of the first light source unit. The second contacting part is electrically connected to the third pad of the second light source unit.

The connector includes: a first connection member which includes the first contacting part and the second contacting part; and a second connection member which includes a first connection portion electrically connected to the first contacting part and a second connection portion electrically connected to the second contacting part, and extends from one side of the first connection member.

The lighting device further includes a cover which is disposed on the light source module and is coupled to the heat sink. The heat sink further includes a guide connected to the outer circumference of the top surface. The cover includes a hook. The guide of the heat sink includes a hitching sill coupled to the hook. The cover includes a reference member. The top surface of the heat sink is coupled to the reference member.

The cover further includes a connection member which has a portion thereof where the hook is disposed.

A plurality of the connection members are disposed on the edge of the cover. The plurality of the connection members are disposed separately from each other.

The lighting device further includes a cover which is disposed on the light source module and is coupled to the heat sink; and a member which is disposed on the heat sink and includes a guide recess in which the light source module and the connector are disposed. The member reflects light incident from the inner surface of the cover toward the cover.

The heat sink includes a first heat radiating fin and a second heat radiating fin. The volume of the first heat radiating fin is greater than that of the second heat radiating fin.

The plural first heat radiating fins and the plural second heat radiating fins are alternately disposed.

An interval between the first heat radiating fin and the second heat radiating fin is equal to or greater than 1 mm and equal to or less than 3 mm.

The lighting device further includes an inner case which is disposed in the receiving recess of the heat sink and in which the power supplier and a molding part having a molding material are disposed. The inner case includes an opening into which the molding material is injected and a packing which blocks the opening. The power supplier includes a wire electrically connected to a socket through the opening of the inner case. The packing includes a gap in which the wire is disposed.

The gap is formed by digging or widening a portion of the outer circumference of the packing in the internal direction of the packing. When the packing is coupled to the opening of the inner case, the gap fixes the wire.

The lighting device includes: an inner case which receives the power supplier and is disposed in the receiving recess of the heat sink; and a socket which is coupled to the inner case and includes a screw recess. The inner case includes a screw thread corresponding to the screw recess of the socket. The screw thread includes a plurality of cavities in which a first wire electrically connecting the power supplier and the socket is disposed. The plurality of cavities are arranged adjacently.

The lighting device includes: an inner case which receives the power supplier and is disposed in the receiving recess of the heat sink; and a socket which is coupled to the inner case. The inner case includes a projection projecting in the direction in which the inner case is coupled to the socket. The inner case includes an opening formed on one side thereof coupled to the socket and includes a packing blocking the opening. The projection of the inner case is disposed around the packing.

The lighting device further includes: an inner case which receives the power supplier and is disposed in the receiving recess of the heat sink; and a holder, together with the inner case, covers the power supplier. The power supplier includes a guide connected to the projection. The holder includes a hole in which the projection of the power supplier is disposed and a guide recess to which the guide of the power supplier is coupled.

A lighting device is provided to include a heat sink which includes a top surface and a receiving recess; a power supplier which is disposed in the receiving recess of the heat sink and includes a projection including an electrode plate; a light source module which is disposed on the heat sink; and a connector which includes a first connection member electrically connected to the light source module and a second connection member electrically connected to the power supplier. The second connection member includes a recess to which the projection of the power supplier is coupled and a connection portion electrically connected to the electrode plate.

When the connection portion contacts with the electrode plate, the connection portion is pushed into the inside of the second connection member. When the connection portion is separated from the electrode plate, the connection portion projects to the recess of the second connection member.

The lighting device further includes: a member which is disposed on the heat sink, includes a guide recess in which the light source module and the connector are disposed and has electrical insulation. The light source module further includes a plurality of light source units and a connecting plate for connecting the light source units. The connecting plate is disposed on the member.

Advantageous Effects

By using the lighting device according to the embodiment, it is possible to easily check where the cover is coupled to the heat sink.

It is also possible to prevent the cover from rotating.

It is also possible to improve an optical efficiency.

It is also possible to electrically connect a plurality of the light source units to each other without wires. Therefore, it is easy to assemble and operate the lighting device.

It is also possible to improve a heat radiation efficiency.

Also, the lighting device according to the embodiment is advantageous in a molding process or a coating process.

It is also possible not to use a wire between the power supplier and the light source unit.

It is also possible to easily assemble the lighting device.

It is also possible to stably fix the power supplier and to prevent the liquid which molds the power supplier from flowing out.

It is also possible to prevent a wire which connects the power supplier with the socket from being damaged.

It is also possible to prevent a wire which connects the power supplier with the socket from moving.

It is also possible to prevent the socket from being damaged.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a heat sink that includes a receiving recess and a top surface having a hole;

a plurality of light source units that include a substrate on the heat sink, a light emitting device on the substrate and a pad on the substrate;

a power supplier that is provided in the receiving recess of the heat sink and includes a projection to output a power signal for driving the light source unit;

a connector to couple to the hole of the heat sink, the connector to include a contacting part for electrically connecting to the pad of the light source unit, and the connector is for electrically connecting to the projection of the power supplier; and a member that is provided on the heat sink and includes a plurality of guide recesses in which the light source units and the connector are provided, wherein the member includes a reflective top surface reflecting incident lights, and wherein the top surface of the heat sink has a plurality of seating recesses in which the light source units are disposed.

2. The lighting device of claim 1, further comprising a cover that is provided on the light source units and is coupled to the heat sink, wherein the member reflects the incident lights from an inner surface of the cover toward the cover.

3. The lighting device of claim 1, wherein the heat sink includes a first heat radiating fin and a second heat radiating fin, and wherein a volume of the first heat radiating fin is greater than a volume of the second heat radiating fin.

4. The lighting device of claim 1, wherein a shape of seating recess corresponds to a shape of the guide recess.

5. The lighting device of claim 1, wherein the power supplier includes the projection to output a power signal for driving the light source unit, wherein the connector includes a recess to which the projection of the power supplier is coupled and a connection portion that is in the recess and is electrically connected to the contacting part, and wherein the projection of the power supplier includes an electrode plate that outputs the power signal and is connected to the connection portion.

6. The lighting device of claim 5, wherein the connector includes a first connection member having the contacting part and a second connection member having the recess and the connection portion, and wherein the second connection member projects outwardly from one side of the first connection member.

7. The lighting device of claim 6, wherein the light source units comprises a first light source unit and a second light source unit, wherein the contacting part comprises a first contacting part electrically connected to the pad of the first light source unit and a second contacting part electrically connected to the pad of the second light source unit, wherein the recess comprises a first recess and a second recess, wherein the connection portion comprises a first connection portion disposed in the first recess and a second connection portion disposed in the second recess, wherein the projection comprises a first projection including a first electrode plate and a second projection including a second electrode plate, wherein the first projection is inserted into the first recess, wherein the second projection is inserted into the second recess, wherein the first electrode plate is connected to the first connection portion, wherein the second electrode plate is connected to the second connection portion.

8. The lighting device of claim 1, further comprising a cover that is on the light source units and is coupled to the heat sink, wherein the heat sink includes a guide connected to an outer circumference of the top surface of the heat sink, wherein the cover includes a hook, wherein the guide of the heat sink includes a hitching sill coupled to the hook, wherein the cover includes a reference member, and wherein the top surface of the heat sink include a reference recess coupled to the reference member.

9. The lighting device of claim 1, further comprising an inner case provided in the receiving recess of the heat sink and in which the power supplier and a molding part having a molding material are provided, wherein the inner case includes an opening into which the molding material is injected and a packing that blocks the opening, wherein the power supplier includes a wire electrically connected to a socket through the opening of the inner case, and wherein the packing includes a gap in which the wire is provided.

10. The lighting device of claim 9, wherein the gap is formed by digging or widening a portion of an outer circumference of the packing in an internal direction of the packing, and wherein when the packing is coupled to the opening of the inner case, the gap fixes the wire.

11. The lighting device of claim 1, further comprising:

an inner case that receives the power supplier and is provided in the receiving recess of the heat sink; and a socket coupled to the inner case and includes a screw recess, wherein the inner case includes a screw thread corresponding to the screw recess of the socket, wherein the screw thread includes a plurality of cavities in which a first wire electrically connecting the power supplier and the socket are provided, and wherein the plurality of cavities are arranged adjacently.

12. The lighting device of claim 1, further comprising:

an inner case that receives the power supplier and is provided in the receiving recess of the heat sink; and a socket coupled to the inner case, wherein the inner case includes a projection projecting in a direction in which the inner case is coupled to the socket, wherein the inner case includes an opening formed on one side thereof coupled to the socket and includes a packing blocking the opening, and wherein the projection of the inner case is disposed around the packing.

13. A lighting device comprising:

a heat sink that includes a receiving recess and a top surface having a hole;

a plurality of light source units that include a substrate on the heat sink, a light emitting device on the substrate and a pad on the substrate;

a power supplier that is provided in the receiving recess of the heat sink and includes a projection to output a power signal for driving the light source unit;

a connector to couple to the hole of the heat sink, the connector to include a contacting part for electrically connecting to the pad of the light source unit, and the connector is for electrically connecting to the projection of the power supplier;

an inner case that receives the power supplier and is provided in the receiving recess of the heat sink; and a holder, together with the inner case, to cover the power supplier, wherein the heat sink includes a bottom surface having the hole, the bottom surface has a groove formed adjacent the hole, wherein the holder includes the guide projection coupled to the groove of the heat sink, and wherein the guide projection includes a hole through which the projection of the power supplier passes.

14. The lighting device of claim 13, wherein the power supplier includes a guide connected to the projection, and wherein the guide projection includes a guide recess to which the guide of the power supplier is coupled.

15. The lighting device of claim 13, wherein the connector includes a recess to which the projection of the power supplier is coupled and a connection portion that is in the recess and is electrically connected to the contacting part, and wherein the projection of the power supplier includes an electrode plate that outputs the power signal and is connected to the connection portion.

16. The lighting device of claim 13, wherein the heat sink includes a first heat radiating fin and a second heat radiating fin, and wherein a volume of the first heat radiating fin is greater than a volume of the second heat radiating fin.

17. The lighting device of claim 13, further comprising a cover that is on the light source units and is coupled to the heat sink, wherein the heat sink includes a guide connected to an outer circumference of the top surface of the heat sink, wherein the cover includes a hook, wherein the guide of the heat sink includes a hitching sill coupled to the hook, wherein the cover includes a reference member, and wherein the top surface of the heat sink include a reference recess coupled to the reference member.

18. The lighting device of claim 13, further comprising a molding part having a molding material provided in the inner case, wherein the inner case includes an opening into which the molding material is injected and a packing that blocks the opening, wherein the power supplier includes a wire electrically connected to a socket through the opening of the inner case, and wherein the packing includes a gap in which the wire is provided.

19. The lighting device of claim 13, further comprising a socket coupled to the inner case and includes a screw recess, wherein the inner case includes a screw thread corresponding to the screw recess of the socket, wherein the screw thread includes a plurality of cavities in which a first wire electrically connecting the power supplier and the socket are provided, and wherein the plurality of cavities are arranged adjacently.

20. The lighting device of claim 1, further comprising a socket coupled to the inner case, wherein the inner case includes a projection projecting in a direction in which the inner case is coupled to the socket, wherein the inner case includes an opening formed on one side thereof coupled to the socket and includes a packing blocking the opening, and wherein the projection of the inner case is disposed around the packing.

* * * * *